United States Patent [19]

DeMars

[11] Patent Number: 4,899,902

[45] Date of Patent: Feb. 13, 1990

[54] NO SPILL LID

[76] Inventor: Robert A. DeMars, 6145 Shoup, Woodland Hills, Calif. 91367

[21] Appl. No.: 351,374

[22] Filed: May 15, 1989

[51] Int. Cl.[4] ..... B65D 41/22

[52] U.S. Cl. ..... 220/254; 220/90.4

[58] Field of Search ..... 220/254, 90.4, 375

[56] References Cited

U.S. PATENT DOCUMENTS

| | | | |
|---|---|---|---|
| 3,188,036 | 6/1965 | Sprung | 220/375 |
| 4,331,255 | 5/1982 | Fournier | 220/90.4 X |
| 4,333,583 | 6/1982 | Montemarano | 220/90.4 |
| 4,350,260 | 9/1982 | Prueher | 220/254 |
| 4,629,088 | 12/1986 | Durgin | 220/254 |
| 4,782,975 | 11/1988 | Coy | 220/90.4 |

*Primary Examiner*—Donald F. Norton

*Attorney, Agent, or Firm*—Cislo & Thomas

[57] ABSTRACT

A lid for a liquid container having a substantially circular opening is disclosed. The lid includes a drinking spout and a cover integrally connected to a portion of the lid by means of a connecting member, with a cover adapted to fit over the drinking spout in friction-fit relationship. The lid of the invention permits removing the cover and resealing the cover with one hand. In the sealed position, the lid provides a liquid tight seal against spilling through the drinking spout.

6 Claims, 1 Drawing Sheet

NO SPILL LID

BACKGROUND OF THE INVENTION

This invention relates generally to improvements in drinking containers, and, more particularly, is concerned with lids for the drinking containers normally provided at fast food service establishments.

The containers provided by fast food establishments are often used in the purchaser's automobile. Many times, children are in the vehicle and also partake of the food and drink obtained at the fast food service establishments. Also, it often happens that, while the vehicle is moving, a driver or one of the passengers may still be using the drinking container. Accordingly, drinking containers and attachments for drinking containers which will prevent inadvertent spilling, when being used for drinking and while awaiting the use of drinking, have long been sought. Further, there is the added problem of sipping a beverage, such as coffee, while driving and yet at the same time having to gain access to the contents of the container. If one is driving, at least one hand is required on the wheel, thus leaving only one hand for removing any cover on the drinking container.

A number patent have addressed various aspects of these problems. For example, U.S. Pat. Nos. 3,927,794 and 4,345,695 disclose a lid for a drinking cup. However, these patents deal with tabs or closures that are depressed into the liquid. U.S. Pat. No. 4,350,260 is to the same effect.

U.S. Pat. No. 4,460,103 provides a lid having a weakening line defining a flap and a hinge for the flap. The flap has a raised pull-tab which may be torn and the flap opened by folding at its hinge section. The lid also has a depressed well section which is adapted to accept the pull-tab and thus retain the flap in an open position. However, the operation for opening the lid obviously requires two hands.

U.S. Pat. No. 4,333,583 discloses a drinking spout cover for a liquid container which comprises a plastic lid having a peripheral edge which protudes downwardly and is designed to engage the lip on the container and an upwardly protuding liquid spout at the edge portion of the cover. The drinking spout cover includes a hollow shaped portion extending upwardly from the cover and having a separate spout affixed thereto along a perforated edge. A small thumb tab may also be provided on the spout cover so that it may be readily pulled backwardly, tearing the cover along the perforations to expose the spout opening for drinking purposes. However, as with the preceding patent, two hands are required to gain access to the liquid in the container.

OBJECTS AND SUMMARY OF THE INVENTION

It is an object of the present invention to provide a lid for a container holding a liquid.

It is a further object of the invention to provide a lid which substantially prevents spills of liquid from the container.

It is yet another object of the invention to provide a lid which has a means integrally associated in the lid for drinking therefrom.

It is another object of the invention to provide a means for sealing the integrally associated drinking means.

It is a still further object of the invention to provide a means for covering and uncovering an integrally associated drinking portion of the lid which may be accomplished through the use of one hand, specifically, the thumb.

These and further objects of the invention will become apparent upon consideration of the following commentary taken in conjunction with the drawing.

In accordance with the invention, a lid is provided for a liquid container having a substantially circular opening. The lid comprises a substantially circular main body portion having a slightly greater diameter than the container opening and a flexible and downwardly extending peripheral portion. The main body portion further includes peripheral recessed portions of an arcuate configuration extending downwardly from the main body portion. The lid further comprises a drinking spout positioned on the main body portion towards the periphery of the lid. The spout comprises an upwardly extending hollow member having a generally arcuate configuration with an unobstructed interior and an opening for passage of liquid therethrough. The lid further comprises a cover integrally connected to a portion of the downwardly extending peripheral portion by means of a connecting member. The cover is adapted to fit over the drinking spout in friction-fit relationship.

DETAILED DESCRIPTION OF THE PREFERRED EMBODIMENTS

Figure 1:
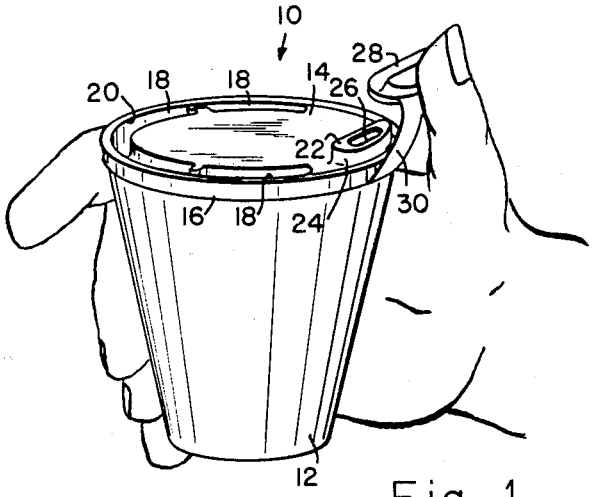
FIG. 1 depicts the lid of the invention associated with a liquid container and its use by a person.
Figure 2:
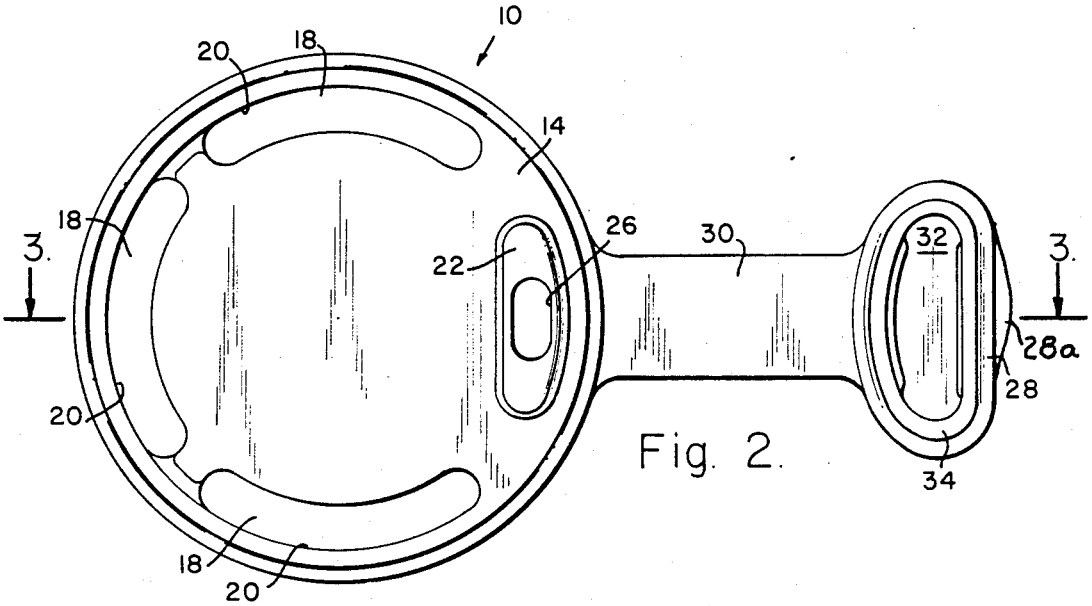
FIG. 2 is a top plan view of the lid of the invention, with the cover portion fully extended from the main body portion.
Figure 3:
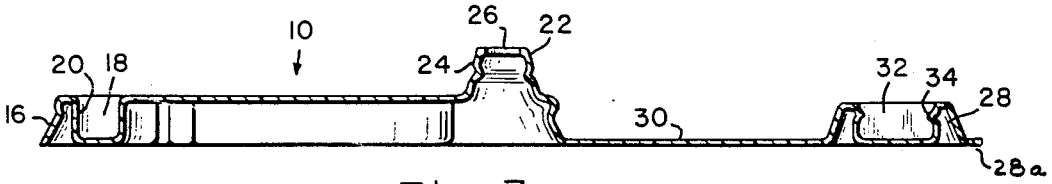
FIG. 3 is a cross-section taken along the line 3—3 of FIG. 2.

Referring now to the drawing wherein like numerals of reference refer to like elements throughout, a lid depicted generally at 10 is shown. The lid is configured for a liquid container 12 having a substantially circular opening.

The lid 10 comprises a substantially circular main body portion 14 having a slightly greater diameter than the circular opening of the container 12. The lid further includes a flexible and downwardly extending peripheral portion 16. The main body portion 14 also includes peripheral recessed portions 18 having an arcuate configuration and extending downwardly from the main body portion. Although three such recessed portions 18 are shown in the figure, fewer or greater number may be employed. The outer periphery 20 of the recessed portion 18 forms an arc having a slightly smaller diameter than the interior diameter of the circular opening of the container 12. Thus, the peripheral portion 16 and outer periphery 20 of the recessed portion 18 cooperate to engage the rim of the container 12 is tight friction-fit relationship, so as to provide a substantially liquid-tight seal that prevents spilling of liquid in the container 12.

The lid 10 may have a small aperture or hole not shown by which to release built-up air pressure or the like as is typically found in lids for association with containers such as cups, or the like with which the lid of the invention is used.

A drinking spout 22 is positioned on the main body portion 14 towards the periphery of the lid 10. The drinking spout 22 comprises an upwardly extending hollow member 24 having a generally arcuate configuration with an unobstructed interior. An opening 26 is provided to permit passage of fluid therethrough.

The opening 26 is unobstructed and is of a size to permit ease of drinking. It will be noted that opening 26 is inner set from the lateral edges of spout 22. Preferably, opening 26 is of somewhat smaller dimension than the surface of the drinking spout 22, most preferably being of oval or elliptical shape.

A cover 28 is integrally connected to a portion of the downwardly extended peripheral portion 16 by means of a connecting member 30. The cover is adapted to fit over the drinking spout 22 in a friction-fit relationship. The connecting member or tab 30 is at least as wide as the drinking spout opening 26 and is long enough to allow sealing and removal of the cover 28 relative to the spout 22 with one hand and more specifically the thumb of the user.

In particular, the cover 28 is provided with a recess 32, defined by peripheral ridge 34. The inside perimeter of the peripheral ridge 34 is slightly larger than the outer dimension of the drinking spout 22 and is of substantially the same arcuate configuration. The recess 32 is of sufficient depth to accommodate substantially all the height of the drinking spout 22. A flange portion 28*a* is provided to facilitate removal of the cover 28 by use of the thumb of the user.

As can be seen in FIG. 1, upon placement of the lid 10 on a container 12 holding a liquid therein, the cover 28 may be removed or returned to position using one hand. In particular, movement of the thumb is all that is required to remove the cover 28 or replace it on the drinking spout 22.

Removal of the cover 28 from the drinking spout 22, of course, permits the user to drink the liquid in the container 12. On the other hand, placement of the cover 28 on the drinking spout 22 forms a substantially liquid-tight seal that prevents spilling of liquid in the container 12 through the drinking spout 22.

The lid 10 is of one piece construction, employing a suitable plastic material, preferably a thermoplastic, having the flexibility both for placement on the container 12 and attachment of the cover 28 to the drinking spout 22.

Thus, a lid for a liquid container for permitting one hand operation and for preventing spills has been disclosed. Various modifications and changes will make themselves available to those of ordinary skill in the art, and all such modifications and changes not deviating from the spirit and scope of the invention are intended to be covered by the appended claims.

What is claimed is:

1. A one-piece, flexible plastic molded lid for a liquid container having a substantially circular opening comprising:

a substantially circular solid main body portion having a slightly greater diameter than said container opening and a flexible and downwardly extending peripheral portion, said main body portion further including peripheral spaced, recessed portions of an arcuate configuration extending downwardly from said main body portion, a portion of the inner wall of said downwardly extending peripheral portion and the outer wall of said peripheral recessed portions cooperatively engaging the uppermost portion of said wall of said container in friction-fit relationship to thereby seal said container;

a low profile, drinking spout positioned on said main body portion adjacent the periphery of said lid, and integral therewith, said spout comprising an upwardly extending, tapered, hollow member having a general arcuate configuration with an unobstructed interior and provided with an unobstructed opening; and a low profile, cover integrally connected to a portion of said downwardly extending peripheral portion by means of a planar connecting member at least as wide as said drinking spout opening and being flexibly attached to the base of said downwardly extending peripheral portion adjacent said spout and having a length sufficient to permit sealing and removal of said cover with respect to said drinking spout by use of a person's thumb for unobstructed drinking, said cover being congruently shaped to said spout and provided with an inner peripheral ridge for sealing said cover to said drinking spout in friction-fit relationship and having an encircling flange to facilitate removal of said cover as set forth above.

2. The lid of claim 1 wherein the outer periphery of said peripheral recessed portions defines an arc having a diameter slightly smaller than the inside diameter of said container.

3. The lid of claim 1 wherein said opening of said drinking spout is of smaller dimension than that of said drinking spout.

4. The lid of claim 3 wherein said opening is of substantially oval shape.

5. The lid of claim 1 wherein said cover is provided with a recess defined by a peripheral ridge.

6. The lid of claim 5, wherein the inside perimeter of said peripheral ridge is slightly larger than the outer dimension of said drinking spout and is of substantially the same arcuate configuration and wherein the depth of said recess is sufficient to accommodate substantially all the height of said drinking spout.

* * * * *